US009970736B2

(12) United States Patent
Beck

(10) Patent No.: US 9,970,736 B2
(45) Date of Patent: May 15, 2018

(54) FEMALE PROTECTIVE VEST

(71) Applicant: Tyr Tactical, LLC, Peoria, AZ (US)

(72) Inventor: Jason Beck, Peoria, AZ (US)

(73) Assignee: Tyr Tactical, LLC, Peoria, AZ (US)

( * ) Notice: Subject to any disclaimer, the term of this patent is extended or adjusted under 35 U.S.C. 154(b) by 0 days. days.

(21) Appl. No.: 15/274,530

(22) Filed: Sep. 23, 2016

(65) Prior Publication Data

US 2017/0234654 A1 Aug. 17, 2017

Related U.S. Application Data

(63) Continuation of application No. PCT/US2016/040989, filed on Jul. 5, 2016.

(60) Provisional application No. 62/188,595, filed on Jul. 3, 2015.

(51) Int. Cl.

| | |
|---|---|
| ***F41H 1/02*** | (2006.01) |
| ***A41D 1/04*** | (2006.01) |
| ***F41H 5/04*** | (2006.01) |

(52) U.S. Cl.

CPC ..... *F41H 1/02* (2013.01); *A41D 1/04* (2013.01); *F41H 5/04* (2013.01)

(58) Field of Classification Search

CPC ..... F41H 1/02; A41D 1/04; A41D 13/0518
See application file for complete search history.

(56) References Cited

U.S. PATENT DOCUMENTS

| | | | | |
|---|---|---|---|---|
| 3,557,384 | A * | 1/1971 | Barron et al. | F41H 1/02 2/2.5 |
| 4,183,097 | A * | 1/1980 | Mellian | F41H 1/02 2/2.5 |
| 4,578,821 | A | 4/1986 | Zufle | |
| 5,020,157 | A * | 6/1991 | Dyer | F41H 1/02 2/2.5 |
| 5,943,694 | A * | 8/1999 | Moureaux | A41D 31/0061 2/2.5 |
| 7,874,022 | B2 * | 1/2011 | McQueer | A41D 13/0015 2/461 |
| 2012/0084906 | A1 | 4/2012 | Sego, Jr. et al. | |
| 2012/0174275 | A1 | 7/2012 | Carlson | |

FOREIGN PATENT DOCUMENTS

| | | | |
|---|---|---|---|
| CA | 2346344 | A1 | 4/2001 |
| DE | 102007048106 | B4 | 4/2010 |

OTHER PUBLICATIONS

International Search Report for Int'l App No. PCT/US2016/040989, dated Sep. 26, 2016.

* cited by examiner

*Primary Examiner* — Tejash Patel
(74) *Attorney, Agent, or Firm* — Polsinelli PC

(57) ABSTRACT

Implementations described and claimed herein provide tactical devices, such as vests and soft ballistic armor, configured for a female wearer and methods of manufacturing the same. In one implementation, a front carrier has an inner surface and an outer surface forming an interior. A front carrier pocket is disposed on the outer surface of the front carrier, and the front carrier pocket is adapted to receive a ballistic hard plate. A soft ballistic armor is disposed in the interior of the front carrier. The soft ballistic armor has an armor female shape defined by a set of lateral portions connecting an upper portion and a lower portion. A lateral dart is disposed in each of the lateral portions. The lateral darts are each adapted to displace the ballistic hard plate in a direction away from the inner surface of the front carrier.

21 Claims, 13 Drawing Sheets

FEMALE PROTECTIVE VEST

CROSS-REFERENCE TO RELATED APPLICATIONS

The present application is a continuation of PCT Application No. PCT/US2016/040989 entitled "FEMALE PROTECTIVE VEST" and filed Jul. 5, 2016, which claims priority to U.S. Provisional Application No. 62/188,595, entitled "Female Protective Vest" and filed on Jul. 3, 2015. Each of these applications is incorporated by reference in its entirety herein.

TECHNICAL FIELD

Aspects of the present disclosure relate to tactical vests devices and more particularly to tactical vests and other tactical devices, such as soft ballistic armor, configured to comport with the female anatomy.

BACKGROUND

Tactical vests, including plate carriers, concealable carriers, low visibility carriers, and the like, are used by military, law enforcement, and other personnel to absorb the impact and protect against penetration to the body from a threat, such as a ballistic projectile and shrapnel from explosions. Such tactical vests are conventionally tailored to fit the body shape of a male individual. Accordingly, when a female individual wears these conventional vests, her motion is typical inhibited. These conventional vests are also uncomfortable due to the lack of support and accommodation for the female anatomy. For example, a hard plate carried by these conventional vests may exert excess compression on the breast tissue of a female wearer. It is with these observations in mind, among others, that various aspects of the present disclosure were conceived and developed.

SUMMARY

Implementations described and claimed herein address the foregoing problems by providing tactical devices configured for a female wearer and methods of manufacturing the same. In one implementation, a tactical vest comprises an upper portion, a lower portion, and a set of lateral portions of a front carrier. The upper portion has a set of arms connected by a contoured center edge, and each of the upper arms has an upper side edge. The lower portion has a set of outwardly extending edges each connected to a lower side edge. The lower side edges extend distally to a bottom edge. Each of the lateral portions have a first edge connected to a second edge at a lateral peak. The first edge is connected to one of the upper side edges of the upper arms at an upper valley, and the second edge is connected to one of the outwardly extending edges of the lower portion at a lower valley. The upper portion, the lower portion, and the set of lateral portions form a carrier female shape.

In another implementation, a front carrier has an inner surface and an outer surface forming an interior. A front carrier pocket is disposed on the outer surface of the front carrier, and the front carrier pocket is adapted to receive a ballistic hard plate. A soft ballistic armor is disposed in the interior of the front carrier. The soft ballistic armor has an armor female shape defined by a set of lateral portions connecting an upper portion and a lower portion. A lateral dart is disposed in each of the lateral portions. The lateral darts are each adapted to displace the ballistic hard plate in a direction away from the inner surface of the front carrier.

In yet another implementation, a soft ballistic armor comprises an upper portion, a lower portion, and a set of lateral portions. The upper portion has a contoured center edge connecting a set of top edges. The upper portion has a set of upper side edges each extending inwardly from one of the top edges. The lower portion has a set of outwardly extending edges each connected to a lower side edge. The lower side edges extend distally to a bottom edge. Each of the lateral portions are connected to one of the upper side edges at an upper valley and to one of the outwardly extending edges at a lower valley. Each of the lateral portions extend outwardly from the upper valley to the lower valley. The upper portion, the lower portion, and the set of lateral portions form an armor female shape. A lateral dart is disposed in each of the lateral portions.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTIONS OF THE DRAWINGS

DETAILED DESCRIPTION

Aspects of the present disclosure involve tactical devices, such as tactical vests and soft ballistic armor, adapted for the natural shape of a female wearer, while providing a full range of motion and support and eliminating excess compression on the breast tissue. The tactical vests may include, without limitation, plate carriers, concealable carriers, low visibility carriers, and the other personal armor, used by military, law enforcement, and other personnel to absorb the impact and protect against penetration to the body from a threat, such as a ballistic projectile and shrapnel from explosions. In one aspect, a tactical vest includes a front carrier having a carrier female shape and a soft ballistic armor having an armor female shape mirroring the carrier female shape. The soft ballistic armor includes a set of lateral darts that contour around the natural shape of the female wearer and displace a hard ballistic plate away from the wearer to eliminate excess compression on the breast tissue. A carrier pocket is positioned on the front carrier to hold the hard ballistic plate. The positioning on the front carrier in conjunction with the carrier female shape holds the hard ballistic plate in an orientation generally parallel to the body of the wearer, preventing projectiles from passing through the ballistic protection uninhibited.

To begin a detailed description of an example female tactical vest 100, reference is made to FIGS. 1-6. It will be appreciated that the female tactical vest 100 illustrated in the Figures is exemplary only and the presently disclosed technology may be implemented as a full tactical entry vest, a plate carrier, a low visibility vest, a concealable vest, or the like.

Figure 1:
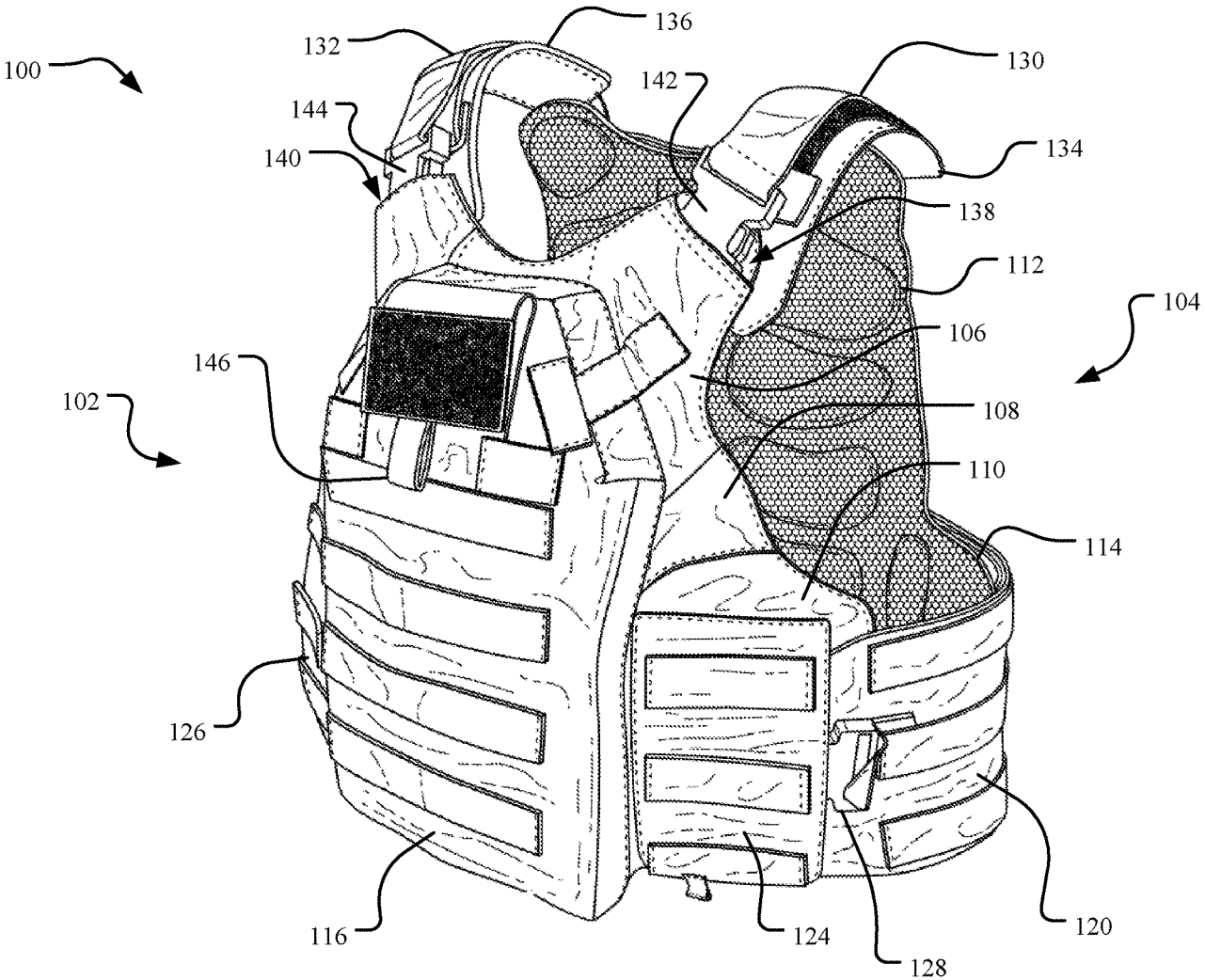
FIG. 1 is a perspective view of an example female tactical vest.
Figure 2:
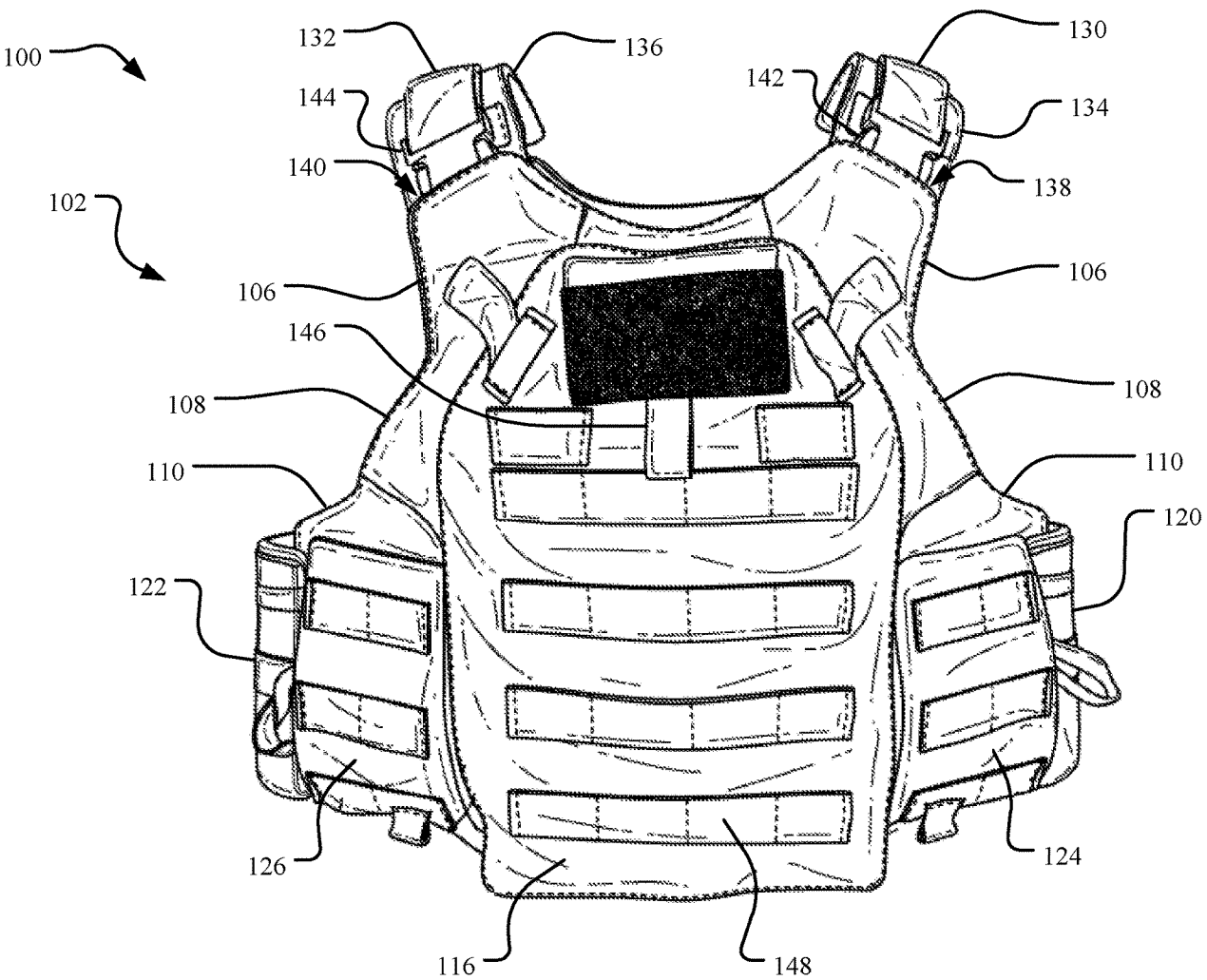
FIGS. 2 and 3 show a front view and a back view, respectively, of the female tactical vest.
Figure 3:
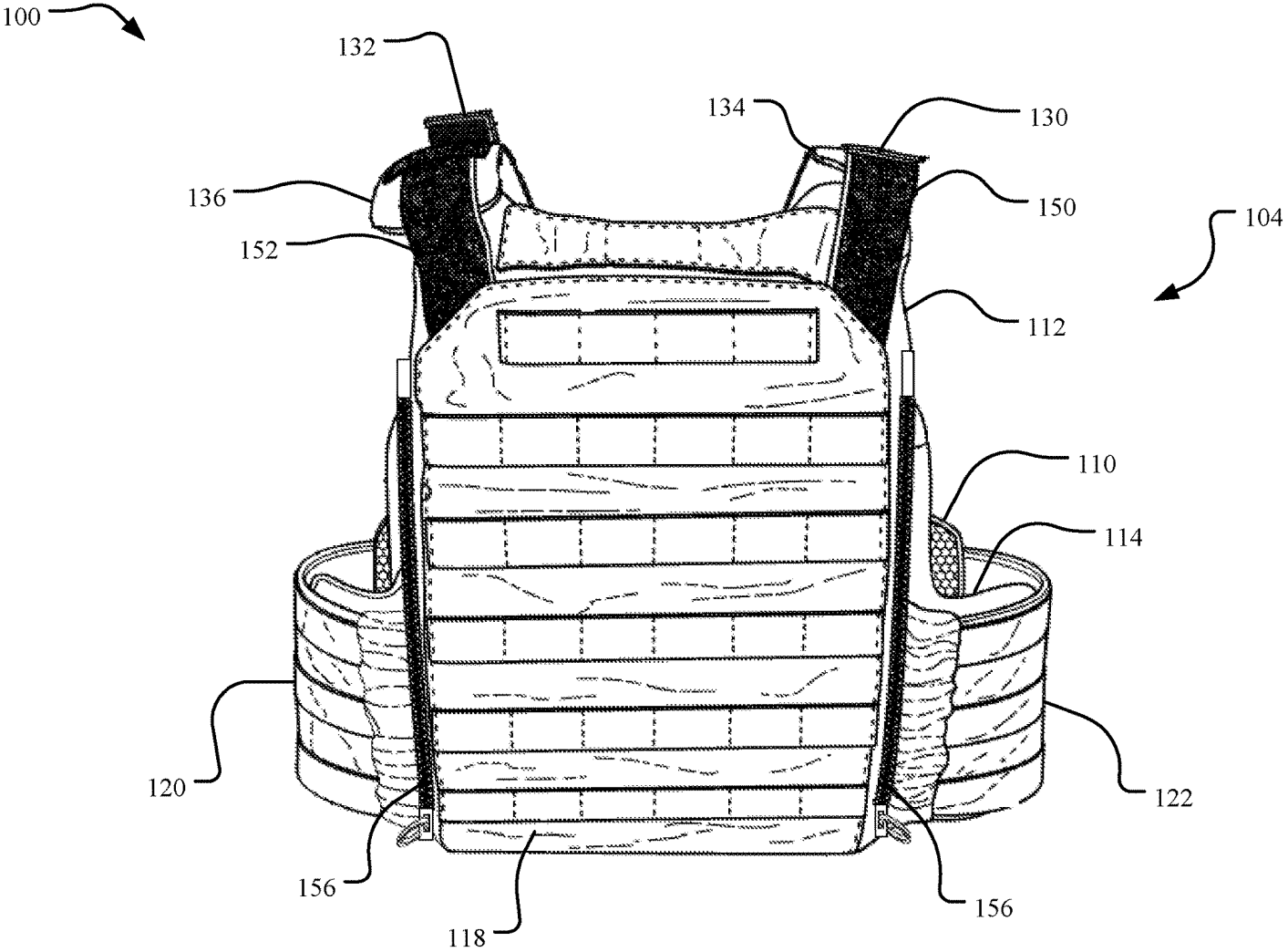

Turning first to FIGS. 1-3, in one implementation, the female tactical vest 100 includes a front carrier 102 and a back carrier 104. The front carrier 102 is shaped to accommodate the anatomy of a female wearer. As such, in one implementation, the front carrier 102 has a carrier female shape formed by an upper portion 106, a set of lateral portions 108, and a lower portion 110. The carrier female shape permits a full range of motion by and provides support to the female wearer, while maximizing comfort. The back carrier 104 similarly includes an upper back portion 112 and a lower back portion 114 adapted to maximize comfort without inhibiting motion of the female wearer.

In one implementation, the female tactical vest 100 includes a front carrier pocket 116 extending from or otherwise attached to the front carrier 102. The front carrier pocket 116 may be adapted to receive and hold one or more protective devices for absorbing the impact and protecting against penetration to the body from a threat, such as a ballistic projectile and shrapnel from explosions. Such protective devices may include, without limitation, a soft body armor, a ballistic hard plate, a ballistic frame, a ballistic plate, a ballistic plate cover, and the like.

For example, a hard plate may be disposed within the front carrier pocket 116 with a stake face oriented away from the wearer and a back face oriented towards the wearer. A ballistic plate cover may wrap around at least a portion of a periphery of the ballistic hard plate to provide additional protection against side spall created by augmentation of the ballistic hard plate. Such a ballistic cover further improves the structure of the front carrier pocket 116 and enhances area coverage and range of motion for increased ergonomics and performance, while providing additional ballistic coverage beyond a front edge of the ballistic hard plate and beyond side edges of the ballistic hard plate.

A soft body armor may be disposed in the front carrier pocket 116 behind the ballistic hard plate on the back face side to provide additional protection and force absorption. A ballistic frame may be disposed within the front carrier pocket 116 behind or in front of the soft body armor. The ballistic frame includes a body configured to improving overall load carriage performance of the front carrier pocket 116 and the female tactical vest 100 by providing a rigid platform to add weight. The frame body further reduces fatigue by improving the structure of the female tactical vest 100 by retaining the soft body armor in a configuration that prevents bunching and provides support to the ballistic hard plate to improve edge hit protection. The ballistic frame is loose from or otherwise unattached to the soft body armor within the front carrier pocket 116. The ballistic frame absorbs and otherwise dissipates energy from an impact of a projectile against the ballistic hard plate and/or the soft body armor. It will be appreciated that such protective devices are exemplary only and that other protective devices may be included in addition or as an alternative to these protective devices.

In one implementation, the back carrier 104 includes a releasable back panel 118, which may be used to releasably connect to or otherwise secure one or more protective devices and/or to integrate with other tactical devices. The back carrier 104 may include a back carrier pocket within, adjacent to, or in place of the releasable back panel 118 to receive and hold one or more protective devices. In one implementation, the releasable back panel 118 is releasably engaged to the back carrier 104 with a zipper assembly 156.

The front carrier 102 is connected to the back carrier 104 at a proximal end and/or a distal end. In one implementation, the front carrier 102 is connected to the back carrier 104 at the distal end with a cummerbund having a first cummerbund portion 120 and a second cummerbund portion 122. It will be appreciated, however, that a belt, straps, or other side connections may supplement or be used in place of the cummerbund. One or more of the cummerbund sections 120 and 122 may be connected to the front carrier 102 using a cummerbund buckle 128. In one implementation, the cummerbund sections 120 and 122 are connected to the front carrier 102 at a first side pocket 124 and a second pocket 126, respectively.

In one implementation, the front carrier 102 is connected to the back carrier 104 at the proximal end with shoulder portions, including a first shoulder strap 150 and a second shoulder strap 152. The shoulder straps 150 and 152 may each be adjustable. For example, the first shoulder strap 150 and the second shoulder strap 152 may loop through a first shoulder buckle 142 and a second shoulder buckle 144 forming an adjustment portion 130 and 132, respectively. The adjustment portions 130 and 132 may be secured, for example, using paired hook and loop fasteners. In one implementation, the shoulder portions include a first shoulder pad 134 and a second shoulder pad 136 with a low to enhance comfort and provide additional load distribution.

The female tactical vest 100 may include a cutaway system permitting single-handed release. In one implementation, the cutaway system includes a plurality of buckles, which when released permit the female tactical vest 100 to be easily and quickly removed. The plurality of buckles may include, for example, the shoulder buckles 142 and 144 and the cummerbund buckle(s) 128. In one implementation, the plurality of buckles is connected to a quick-release tab 146 via corresponding wires. When the quick-release tab 146 is pulled, each of the plurality of buckles is automatically disengaged, facilitating the removal of the female tactical vest 100. The cutaway system may be reengaged and the female tactical vest 100 reassembled by reengaging the plurality of buckles. In one implementation, the wires are housed within an interior of the female tactical vest 100 and in communication with the buckles using one or more pockets or openings. For example, the first side pocket 124 and a second pocket 126 may cover at least a portion of the cummerbund buckle(s) 128 and provide access to the wires. Similarly, the upper portion 106 of the front carrier 102 may include a first buckle pocket 138 and a second buckle pocket 140 providing access to the wires for the first shoulder buckle 142 and the second shoulder buckle 144, respectively.

Figure 4:
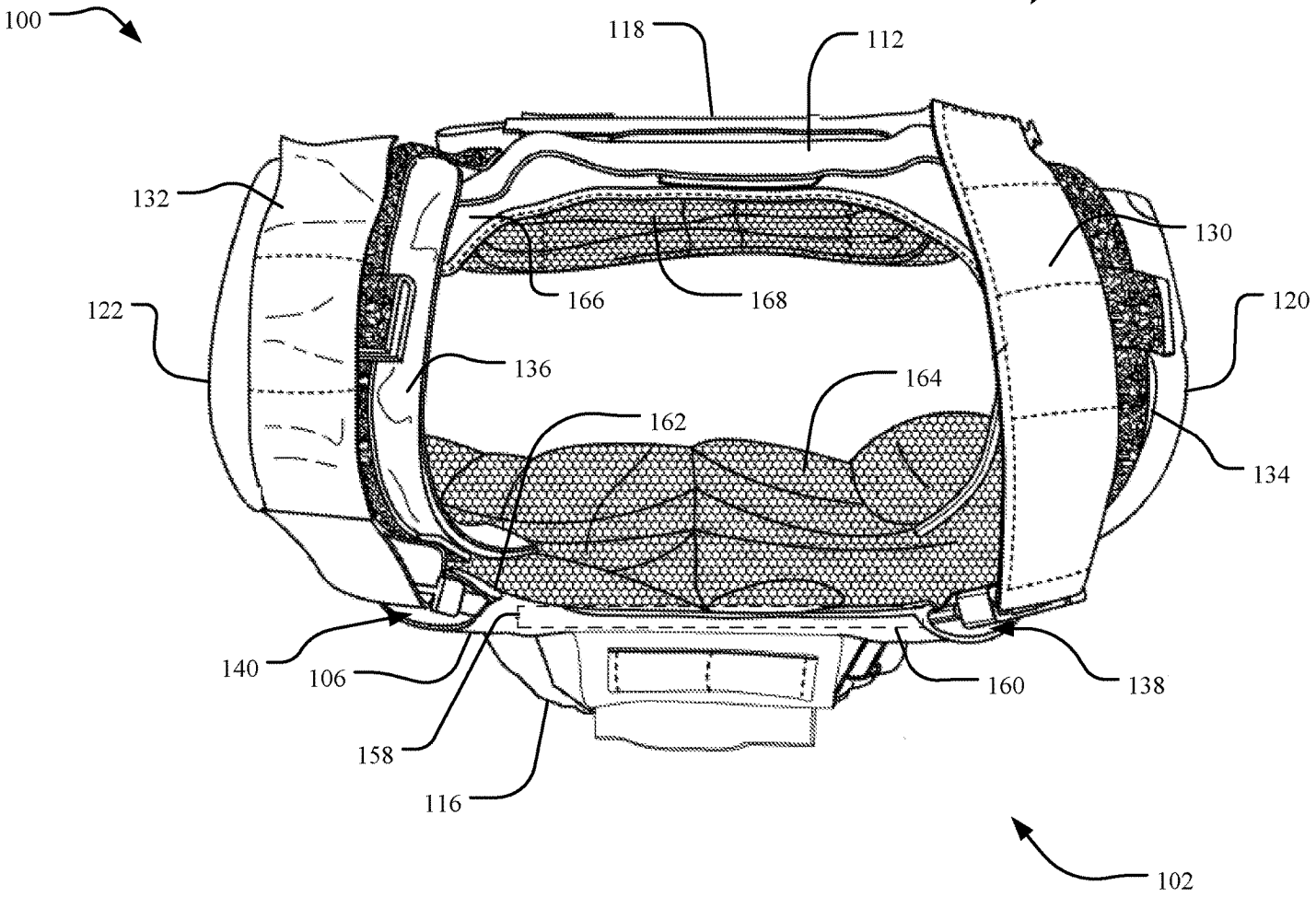
FIGS. 4 and 5 illustrate a top view and a bottom view, respectively, of the female tactical vest.
Figure 5:
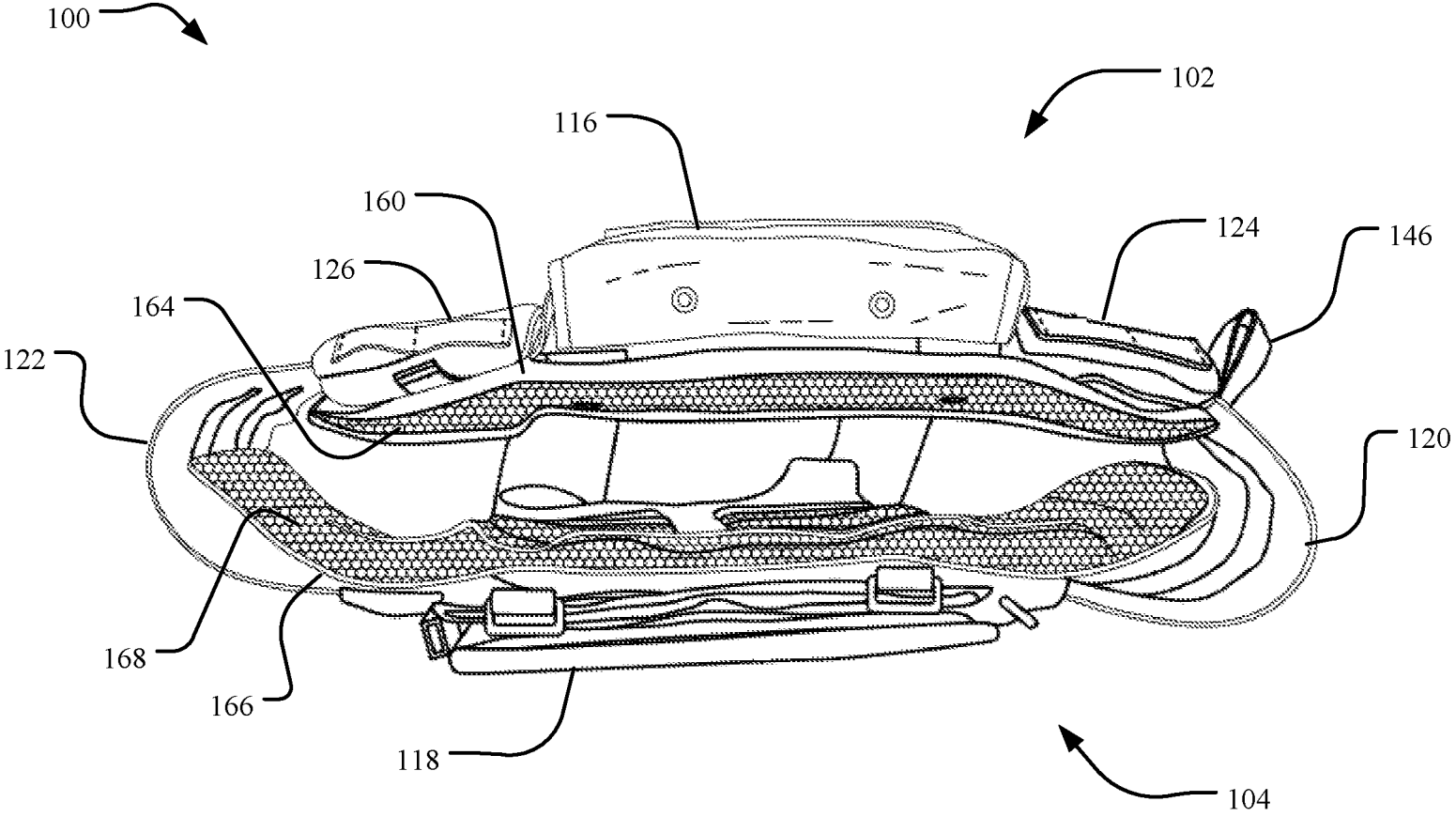
Figure 6:
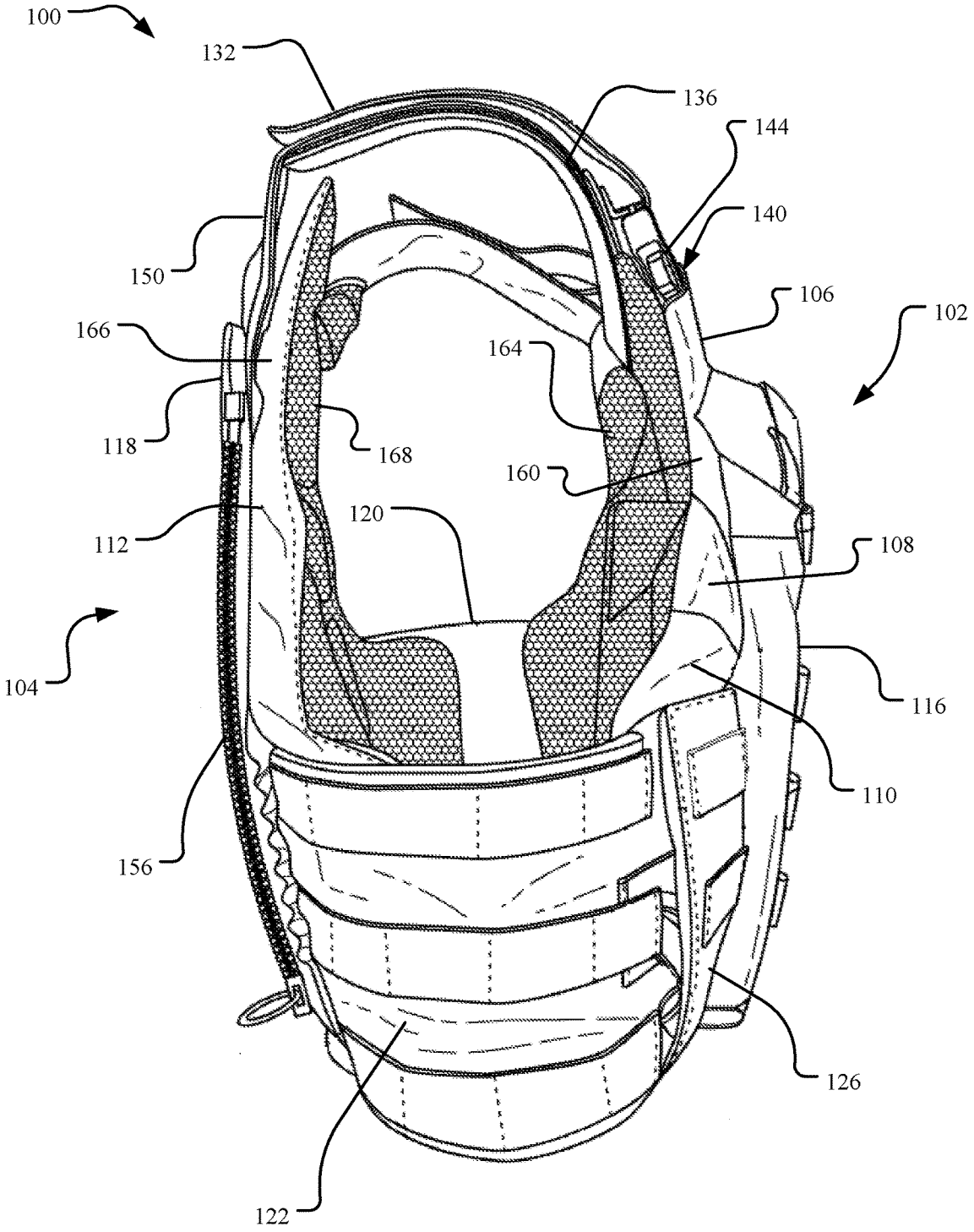
FIG. 6 depicts a side view of the female tactical vest.

Referring to FIGS. 4-6, in one implementation, the front carrier 102 includes an outer surface 160 and an inner surface 162 forming an interior 158 therebetween, which may house one or more protective devices, such as a soft ballistic armor. The outer surface 160 of the front carrier 102 is exposed to an outside environment and is distal from the inner surface 162 to the wearer of the female tactical vest 100. Stated differently, the inner surface 162 faces the wearer and the outer surface 160 faces away from the wearer. In one implementation, the outer surface 160 is made from a lightweight hybrid material with superior abrasion, tear, and fire resistance characteristics, while providing load carriage support and improved durability, particularly in high-wear areas, such as corners, edges, seams, and exposed areas. The lightweight hybrid material of the outer surface 160 may be, for example, a laminate of 500-denier nylon and 200-400-denier para-aramid fibers in an ultra-tight weave. In one implementation, the inner surface 162 includes a padded spacer mesh 164 attached thereto to enhance comfort. An outer surface 166 of the back carrier 104 and other outer facing surfaces of the female tactical vest 100 may be made from similar materials to the outer surface 160 of the front carrier 102, and the back carrier 104 may include a padded spacer mesh 168 similar to the padded spacer mesh 164 of the front carrier 102. The padded spacer meshes 164 and 168 may be made from a material that is antimicrobial and fire resistant treated.

Figure 7:
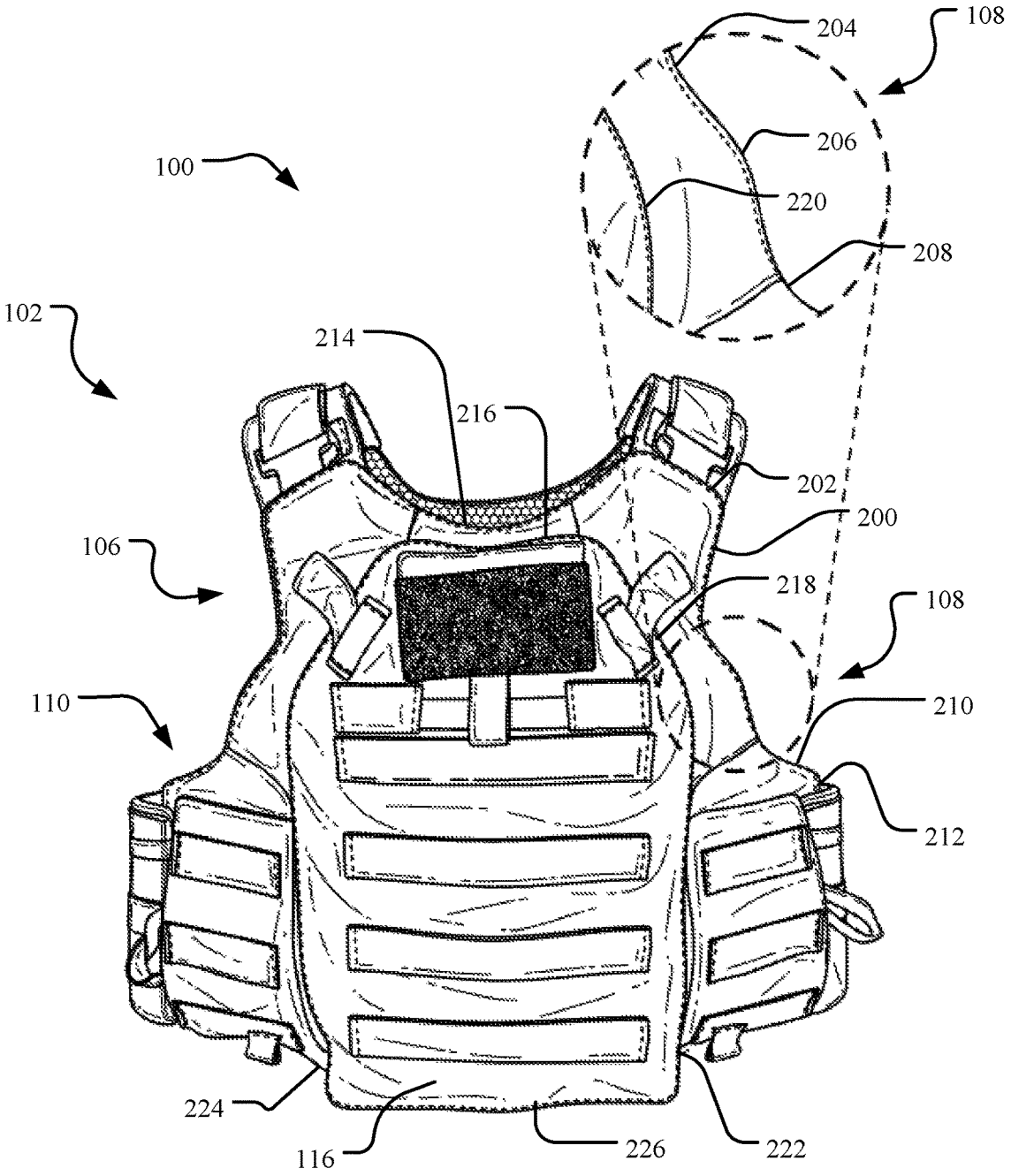
FIG. 7 illustrates a front view and a detailed view of a front carrier of the female tactical vest.

For a detailed description of the carrier female shape of the front carrier 102, reference is made to FIG. 7. The carrier female shape is formed by the upper portion 106, the set of lateral portions 108, and the lower portion 110. In one implementation, the upper portion 106 includes a set of arms configured to releasably engage the shoulder portions. The set of arms each have an upper side edge 200 extending distally from a top edge 202. The upper side edges 200 may further extend along a contour to enhance ergonomics and accommodate the anatomy of a female wearer. For example, the upper side edges 200 may each extend inwardly from the top edge 202 in a direction generally towards a central axis extending from the proximal end of the female tactical vest 100 to the distal end. The set of arms in the upper portion 106 are connected by a center edge 214, which may be a contoured. In one implementation, the center edge 214 contours distally from each of the top edges 202 until reaching a central point.

The set of arms of the upper portion 106 are each connected to a respective lateral portion 108. In one implementation, the upper side edge 200 of each of the upper arms is connected to the lateral portion 108 at an upper valley 204. An edge of each of the lateral portions 108 extends from the upper valley 204 in a direction generally outwardly away from the central axis of the female tactical vest 100 to a lower valley 208. In one implementation, each of the lateral portions 108 includes a lateral peak 206. The edge of each of the lateral portions 108 may include a first edge extending from the upper valley 204 to the lateral peak 206 and a second edge extending from the lateral peak 206 to the lower valley 208. The first edge, lateral peak 206, and the second edge may extend outwardly at angle along a line, forming a generally straight line angling from the upper valley 204 to the lower valley 208. In another implementation, the first edge contours from the upper valley 204 to the lateral peak 206, and the second edge contours from the lower valley 208 to the lateral peak 206. Each of the lateral portions 108 may include lateral darts extending from the edge of the lateral portion 108 inwardly and distally.

The lower portion 110 is connected to the upper portion 106 with the set of lateral portions 108. In one implementation, the lower valleys 208 of the lateral portions 108 connect to a set of outwardly extending edges 210 of the lower portion 110. Stated differently, the lower valley 208 connects the second edge of the lateral portion 108 to the outwardly extending edge 210. The outwardly extending edges 210 may each be disposed at an angle relative to lower side edges 212 of the lower portion 110 and extend outwardly from the lower valleys 208 to the lower side edges 212. In one implementation, the lower side edges 212 each extend distally from the outwardly extending edges 210 to a bottom edge 224, which may extend horizontally between the lower side edges 212.

The front carrier pocket 116 is disposed on the outer surface 160 of the front carrier 102, with the front carrier 102 shaped and otherwise configured to distribute the load of carried by the front carrier pocket 116 while promoting comfort by accommodating the female anatomy, as described herein. In one implementation, the front carrier pocket 116 includes a pocket top edge 216 disposed opposite a pocket bottom edge 226. A first pocket side edge 218 and a second pocket side edge 222 connect the pocket top edge 216 to the pocket bottom edge 226. In one implementation, the first pocket side edge 218 is connected to the second pocket side edge 222 at a pocket peak 220, with the first pocket side edge connecting the pocket top edge 216 to the pocket peak and the second pocket side edge 222 connecting the pocket bottom edge 226 to the pocket peak 220. The first pocket side edge 218 may be disposed at an angle relative to the second pocket side edge 222.

Figure 8:
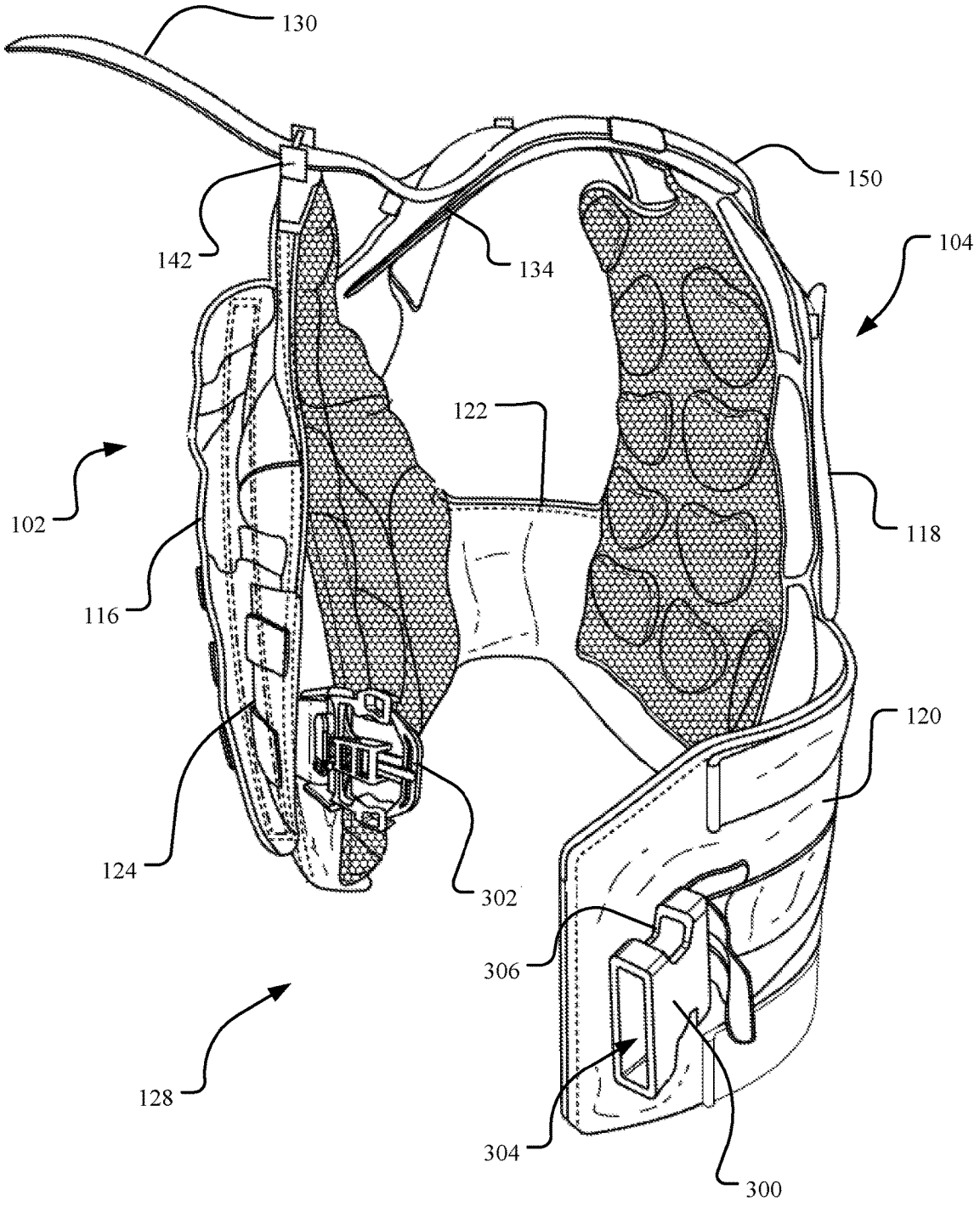
FIG. 8 shows a side perspective view of the female tactical vest with a cummerbund belt buckle released.
Figure 9:
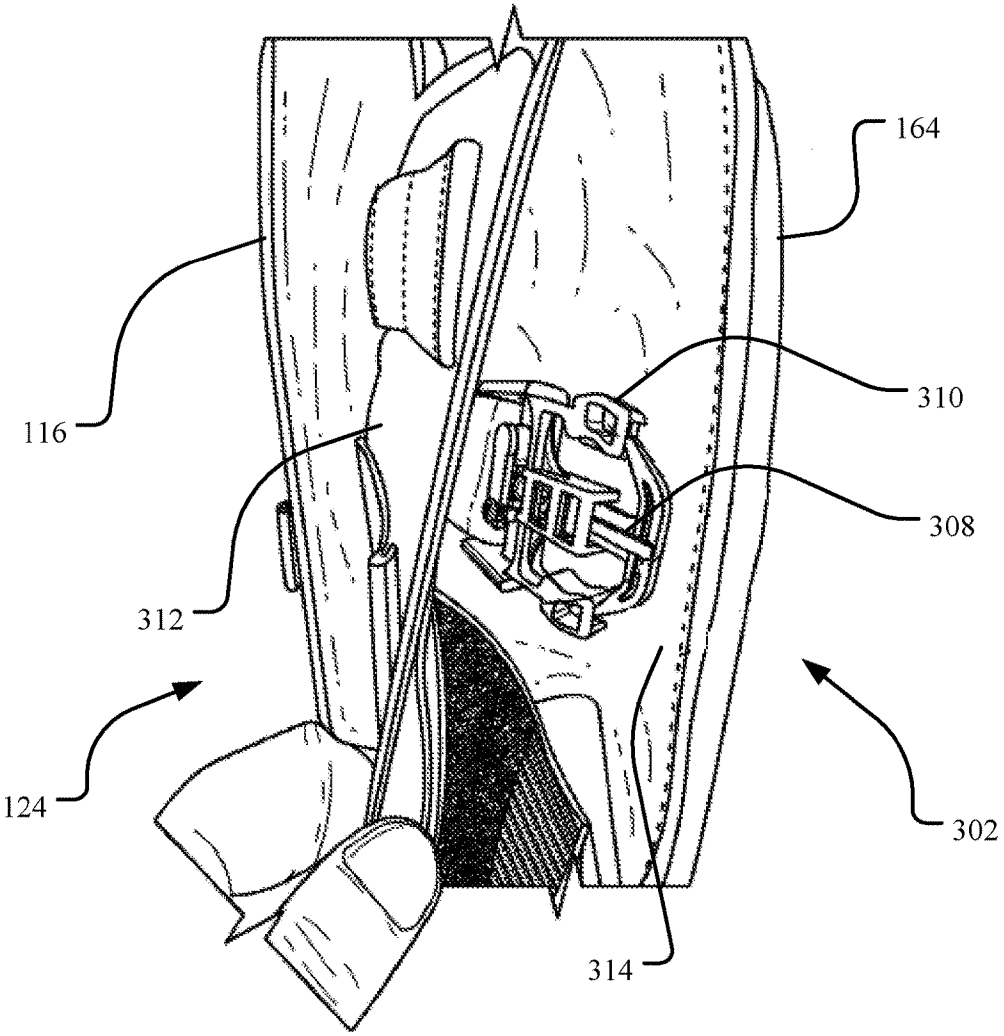
FIG. 9 depicts a detailed view of the cummerbund belt buckle.

Referring to FIGS. 8 and 9, as described herein, the front carrier 102 may be connected to the back carrier 104 with a plurality of buckles, such as the shoulder buckles 142 and 144 and the cummerbund buckles 128. In one implementation, each of the buckles are connected to a cutaway system via one or more wires to release the buckles upon pulling of the quick-release tab 146. For example, the cummerbund buckle 128 may include a female buckle portion 300 and a male buckle portion 302. The female buckle portion 300 includes an opening 304 adapted to receive a body of the male buckle portion 302 and slots 306 to releasably engage buckle arms 310 of the male buckle portion 302. In one implementation, a releasing member 308 is connected to a wire of the cutaway system and configured to displace the buckle arms 310. When the quick-release tab 146 is pulled, the wires of the cutaway system are displaced, which displaces the releasing member 308 and in turn the buckle arms 310, thereby disengaging the male buckle portion 302 from the female buckle portion 300. In one implementation, the male buckle portion 302 is disposed within an interior of the first side pocket 124 formed by an outer layer 312 and an inner layer 314. The shoulder buckles 142 and 144 may include similar features and functionality.

Figure 10:
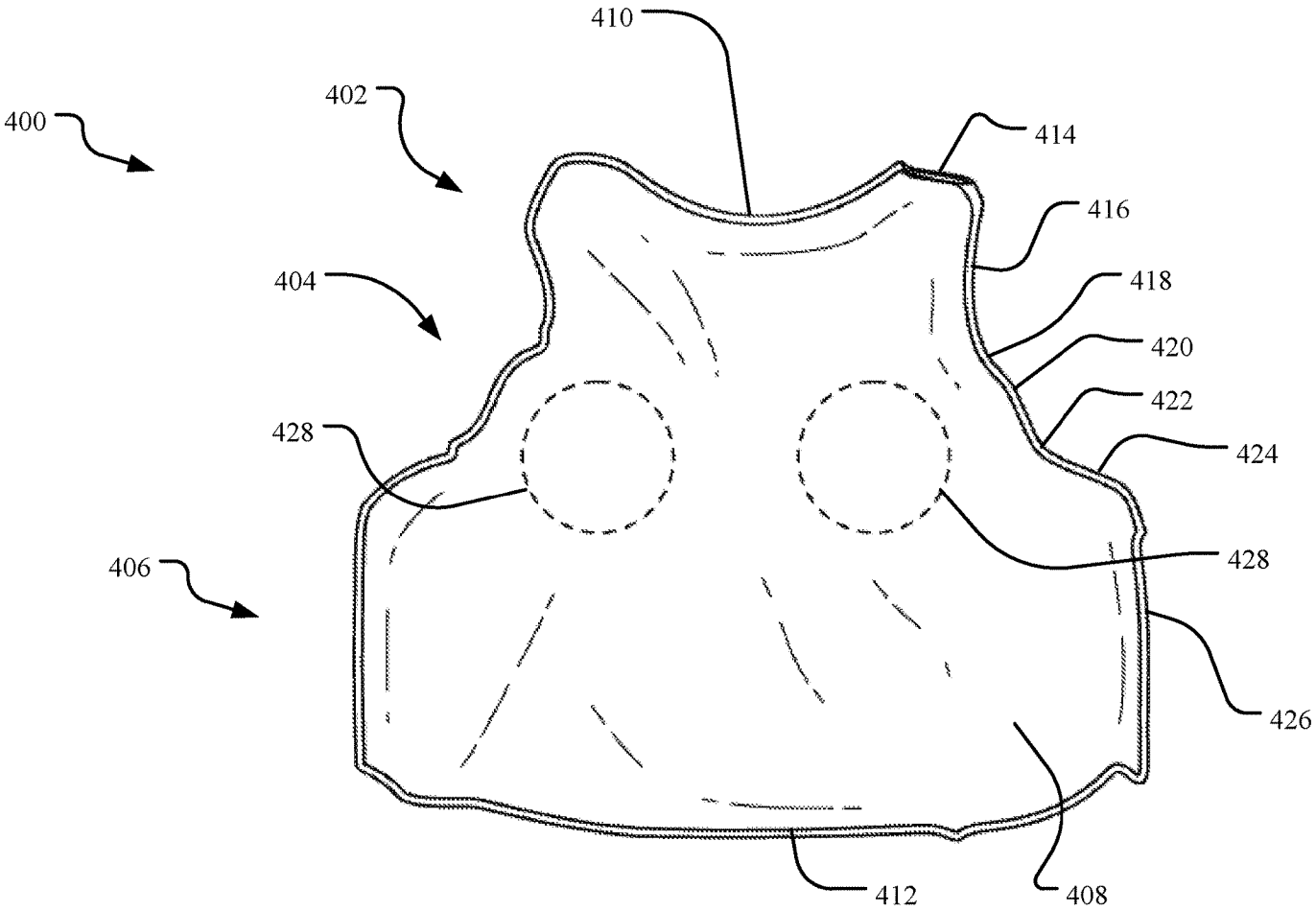
FIG. 10 shows a front view of a soft ballistic armor.
Figure 11:
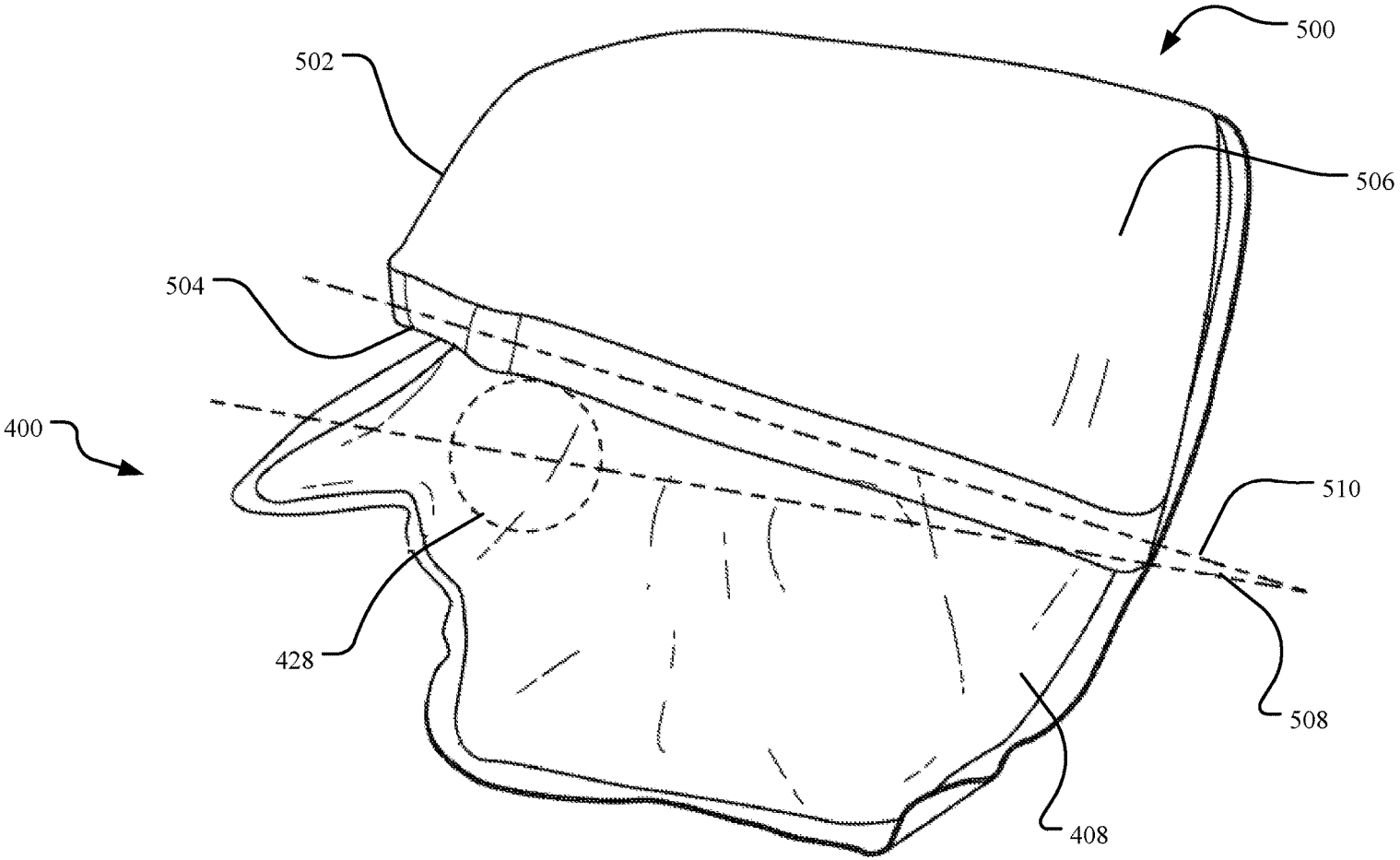
FIG. 11 illustrates a ballistic hard plate displaced at an angle relative to the soft ballistic armor.

As can be understood from FIGS. 10 and 11, in one implementation, a soft ballistic armor 400 formed from one or more panels 408 has an armor female shape mirroring the carrier female shape of the front carrier 102. The soft ballistic armor 400 may be disposed within the interior 158 of the front carrier 102. In one implementation, the armor female shape of the soft ballistic armor 400 is formed from an upper portion 402, a set of lateral portions 404 and a lower portion 406. The set of lateral portions 404 connect the upper portion 402 to the lower portion 406.

In one implementation, the upper portion 402 includes a set of upper side edges 416 each extending distally from a top edge 414. The upper side edges 416 may further extend along a contour to enhance ergonomics and accommodate the anatomy of a female wearer. For example, the upper side edges 416 may each extend inwardly from the top edge 414 in a direction generally towards a central axis 508 extending from a proximal end of the soft ballistic armor 400 to a distal end. The top edges 414 are connected by a center edge 410, which may be a contoured. In one implementation, the center edge 410 contours distally from each of the top edges 414 until reaching a central point. The top edges 414 may contour from the upper side edges 416 into the center edge 410.

In one implementation, each of the upper side edges 416 is connected to the lateral portion 404 at an upper valley 418. An edge of each of the lateral portions 404 extends from the upper valley 418 in a direction generally outwardly away from the central axis 508 to a lower valley 422. In one implementation, each of the lateral portions 404 includes a lateral peak 420. The edge of each of the lateral portions 404 may include a first edge extending from the upper valley 418 to the lateral peak 420 and a second edge extending from the lateral peak 420 to the lower valley 422. The first edge, lateral peak 420, and the second edge may extend outwardly at angle along a line, forming a generally straight line angling from the upper valley 418 to the lower valley 422. In another implementation, the first edge contours from the upper valley 418 to the lateral peak 420, and the second edge contours from the lower valley 422 to the lateral peak 420.

The lower portion 406 is connected to the upper portion 402 with the set of lateral portions 404. In one implementation, the lower valleys 422 of the lateral portions 404 connect to a set of outwardly extending edges 424 of the lower portion 406. Stated differently, the lower valley 422 connects the second edge of the lateral portion 404 to the outwardly extending edge 424. The outwardly extending edges 424 may each be disposed at an angle relative to lower side edges 426 of the lower portion 406 and extend outwardly from the lower valleys 422 to the lower side edges 426. In one implementation, the lower side edges 426 each extend distally from the outwardly extending edges 424 to a bottom edge 412, which may extend horizontally between the lower side edges 426.

Each of the lateral portions 404 may include lateral darts extending from the edge of the lateral portion 404 inwardly and distally. In one implementation, the lateral darts form cup portions 428. As can be understood in FIG. 11, the lateral darts are each adapted to displace a ballistic hard plate 500 to eliminate excess compression on the breast tissue of the female wearer. More particularly, the ballistic hard plate 500 includes a body 502 having a strike face 506 and a back face 504. The lateral darts displace a proximal end the body 502 ballistic hard plate 500 in a direction away from the inner surface 162 of the front carrier 102 and the soft ballistic armor 400 (i.e., a direction away from the wearer). As such, a central axis 510 of the hard ballistic plate 500 is disposed at an angle relative to the central axis 508 of the soft ballistic armor 400. The female carrier shape of the front carrier 102 may position the front carrier pocket 116, such that the hard ballistic plate 500 is maintained in the front carrier pocket 116 in an orientation generally parallel to the body of the wearer, preventing projectiles from moving through the ballistic protection into the body of the wearer, while eliminating compression on the breast tissue by displacing the proximal end of the hard ballistic plate 500 outwardly.

Figure 12:
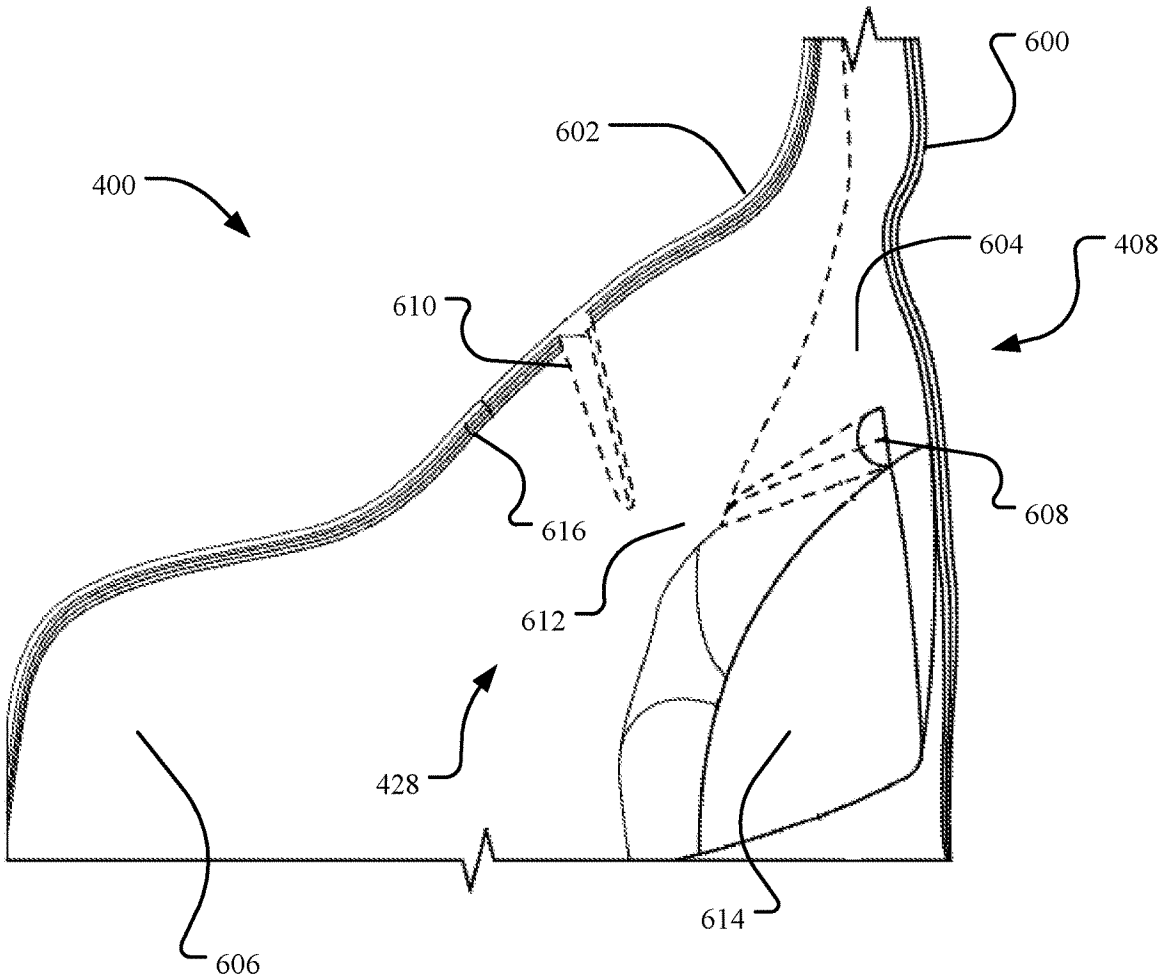
FIG. 12 shows a perspective cut-away view of the soft ballistic armor.

Turning to FIG. 12, in one implementation, the one or more panels 408 includes a first panel 600 having one or more layers and a second panel 602 having one or more layers. The first panel 600 includes an inner surface 604 and the second panel 602 has an inner surface 606. In one implementation, the lateral darts are each formed from one or more raised pleats. For example, a first raised pleat 608 may be formed along the inner surface 604 of the first panel 600, and a second raised pleat 610 may be formed along the inner surface 606 of the second panel 602. The raised pleats 608 and 610 may each extend from a center area 612 of a respective cup portion 428 to a periphery 616. In one implementation, the raised pleats 608 and 610 form free space 614 of the cup portion 428 between the first panel 600 and the second panel 602. The raised pleats 608 and 610 may each be formed using a plurality of sewing lines extending from the center area 612 to the periphery 616. In one implementation, the lateral darts formed from the raised pleats 608 and 610 extend from the center area 612 to an edge of the lateral portion 404 of the soft ballistic armor 400 disposed between the upper valley 418 and the lower valley 422. After the raised pleats 608 and 610 are formed, the first panel 600 may be attached to the second panel 602, for example, using sewing, lamination (e.g., with an adhesive,) to form the soft ballistic armor 400.

Figure 13:
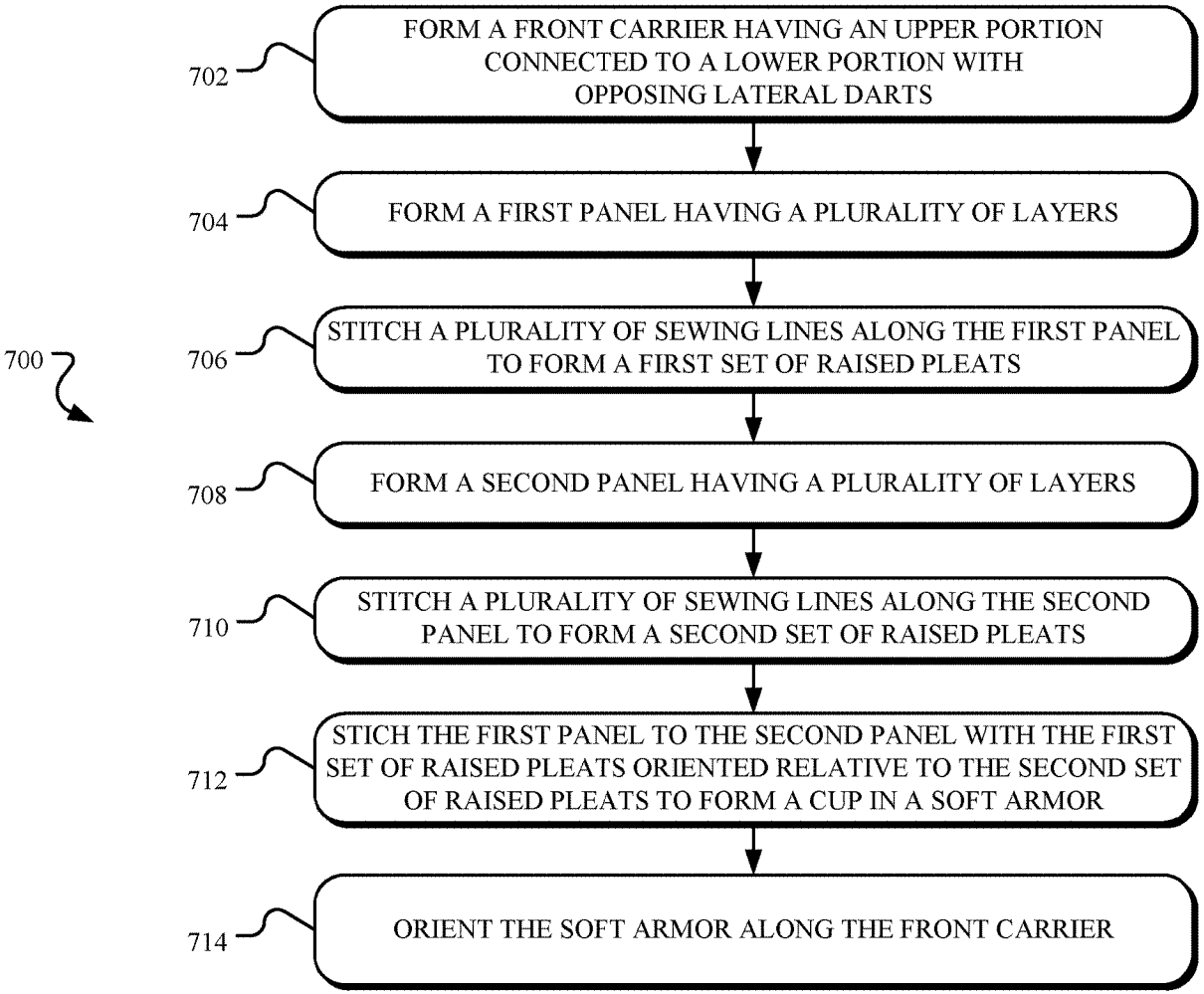
FIG. 13 illustrates example operations for manufacturing a female tactical vest.

FIG. 13 illustrates example operations 700 for manufacturing a female tactical vest. In one implementation, an operation 702 forms a front carrier having an upper portion connected to a lower portion with opposing lateral darts. An operation 704 forms a first panel from a plurality of layers of ballistic material. An operation 706 stitches a plurality of sewing lines along the first panel to form a first set of raised pleats, which may include one or more raised pleats. An operation 708 forms a second panel from a plurality of layers of ballistic material. An operation 710 stitches a plurality of sewing lines along the second panel to form a second set of raised pleats, which may include one or more raised pleats. An operation 712 stitches or otherwise attaches the first panel to the second panel with the first set of raised pleats oriented relative to the second set of raised pleats to form a cup in a soft ballistic armor. An operation 714 orients the soft ballistic armor along the front carrier, for example, in an interior of the front carrier.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A tactical vest comprising:

an upper portion of a front carrier, the upper portion having a set of arms connected by a contoured center edge, each of the upper arms having an upper side edge;

a lower portion of the front carrier, the lower portion having a set of outwardly extending edges each connected to a lower side edge, the lower side edges extending distally to a bottom edge; and a set of lateral portions of the front carrier, each of the lateral portions having a first edge connected to a second edge at a lateral peak, the first edge connected to one of the upper side edges of the upper arms at an upper valley, the second edge connected to one of the outwardly extending edges of the lower portion at a lower valley, the upper portion, the lower portion, and the set of lateral portions forming a carrier female shape.

2. The tactical vest of claim 1, wherein the front carrier has an inner surface and an outer surface defining an interior.

3. The tactical vest of claim 2, wherein a soft ballistic armor is disposed within the interior of the front carrier.

4. The tactical vest of claim 3, wherein the soft ballistic armor includes a set of lateral darts disposed relative to the lateral portion of the front carrier.

5. The tactical vest of claim 3, wherein the soft ballistic armor has an armor female shape mirroring the carrier female shape.

6. The tactical vest of claim 1, wherein the first edge contours from the upper valley to the lateral peak and the second edge contours from the lower valley to the lateral peak.

7. The tactical vest of claim 1, wherein the first edge, the second edge, and the lateral peak extend along a line.

8. The tactical vest of claim 1, wherein the upper side edges each extend inwardly from a top edge to the upper valley.

9. The tactical vest of claim 1, wherein the bottom edge extends horizontally between the lower side edges.

10. The tactical vest of claim 1, wherein the outwardly extending edges are disposed at an angle relative to the lower side edges.

11. A tactical vest comprising:

a front carrier having an inner surface and an outer surface forming an interior;

a front carrier pocket disposed on the outer surface of the front carrier, the front carrier pocket adapted to receive a ballistic hard plate;

a soft ballistic armor disposed in the interior of the front carrier, the soft ballistic armor having an armor female shape defined by a set of lateral portions connecting an upper portion and a lower portion; and a lateral dart disposed in each of the lateral portions, the lateral darts each adapted to displace the ballistic hard plate in a direction away from the inner surface of the front carrier.

12. The tactical vest of claim 11, wherein the front carrier has a carrier female shape mirroring the armor female shape.

13. The tactical vest of claim 12, wherein the carrier female shape positions the front carrier pocket such that the ballistic hard plate is maintained in an orientation parallel to the inner surface of the front carrier.

14. The tactical vest of claim 11, wherein the front carrier is attached to a back carrier.

15. The tactical vest of claim 14, wherein the back carrier includes a releasable back panel.

16. The tactical vest of claim 14, wherein the front carrier is attached to the back carrier with a plurality of buckles.

17. The tactical vest of claim 16, wherein the plurality of buckles are each connected to a cutaway system having a quick-release tab configured to release each of the plurality of buckles upon pulling.

18. A soft ballistic armor comprising:

an upper portion having a contoured center edge connecting a set of top edges, the upper portion having a set of upper side edges each extending inwardly from one of the top edges;

a lower portion having a set of outwardly extending edges each connected to a lower side edge, the lower side edges extending distally to a bottom edge;

a set of lateral portions, each of the lateral portions connected to one of the upper side edges at an upper valley and to one of the outwardly extending edges at a lower valley, each of the lateral portions extending outwardly from the upper valley to the lower valley, the upper portion, the lower portion, and the set of lateral portions forming an armor female shape; and a lateral dart disposed in each of the lateral portions.

19. The soft ballistic armor of claim 18, wherein each of the lateral portions includes a first edge extending along a first contour from the upper valley to a lateral peak and a second edge extending along a second contour from the lower valley to the lateral peak.

20. The soft ballistic armor of claim 18, wherein each of the lateral darts extends from a center of a cup portion to an edge disposed between the upper valley and the lower valley.

21. The soft ballistic armor of claim 18, wherein the upper portion, the lower portion, and the set of lateral portions are made from one or more ballistic panels having a plurality of layers.

* * * * *